US011098496B2

(12) United States Patent
Kwiatkowski

(10) Patent No.: US 11,098,496 B2
(45) Date of Patent: Aug. 24, 2021

(54) MODULAR POOL SYSTEM

(71) Applicant: Natalya Carina Kwiatkowski, Ottawa (CA)

(72) Inventor: Natalya Carina Kwiatkowski, Ottawa (CA)

( * ) Notice: Subject to any disclaimer, the term of this patent is extended or adjusted under 35 U.S.C. 154(b) by 29 days.

(21) Appl. No.: 15/949,771

(22) Filed: Apr. 10, 2018

(65) Prior Publication Data

US 2019/0106896 A1 Apr. 11, 2019

Related U.S. Application Data

(60) Provisional application No. 62/546,863, filed on Aug. 17, 2017.

(51) Int. Cl.
*E04H 4/00* (2006.01)

(52) U.S. Cl.
CPC ..... *E04H 4/005* (2013.01)

(58) Field of Classification Search
CPC ... E04H 4/0018; E04H 4/0031; E04H 4/0043; E04H 4/005; E04H 4/0056
See application file for complete search history.

(56) References Cited

U.S. PATENT DOCUMENTS 3,530,512 A * 9/1970 McBride ..... E04H 4/0031 52/169.7
4,283,804 A * 8/1981 Mahoney ..... E04H 4/0043 4/506
4,577,859 A * 3/1986 Gossett ..... A63B 69/12 182/3
5,875,500 A * 3/1999 Shaanan ..... E04H 4/005 4/506
6,421,846 B1 * 7/2002 Shaanan ..... E04H 4/005 4/506
6,477,721 B2 * 11/2002 Lee ..... E04H 4/0056 4/506
2010/0031434 A1 * 2/2010 Tassone, Jr. ..... E04H 4/0043 4/506

FOREIGN PATENT DOCUMENTS

DE 8429963 U1 * 4/1992 ..... E04H 4/0018
FR 1563417 A * 4/1969 ..... E04H 4/0018
GB 2400798 A 10/2004
KR 200440610 Y1 * 6/2008

OTHER PUBLICATIONS

Machine translation for FR1563417A (Year: 2019).*

* cited by examiner

*Primary Examiner* — Erin Deery
(74) *Attorney, Agent, or Firm* — Sandberg Phoenix & von Gontard, P.C.

(57) ABSTRACT

Described are pool brackets for use in assembling a pool frame for a pool. The pool brackets may be used as a primary building block for constructing free-standing rectangular cuboid swimming pools. Also described are pool frames, pools, panels, including non-homogenous multi-function wall panels; and, kits for assembling pool brackets, pool frames, and pools.

14 Claims, 11 Drawing Sheets

MODULAR POOL SYSTEM

CROSS REFERENCE TO RELATED APPLICATIONS

This application claims the benefit under 35 U.S.C § 119(e) of U.S. Provisional Patent Application No. 62/546,863 filed in the name of the inventor of the present application on Aug. 17, 2017, and titled MODULAR POOL SYSTEM, the entire content of which is incorporated herein by reference.

FIELD

The present disclosure relates generally to modular pool systems.

BACKGROUND

This section is intended to introduce various aspects of the art, which may be associated with the present disclosure. This discussion is believed to assist in providing a framework to facilitate a better understanding of particular aspects of the present disclosure. Accordingly, it should be understood that this section should be read in this light, and not necessarily as admissions of prior art.

Various modular or component swimming pools are known, some of which will now be described. Terms such as "panel pools" and "modular pools" are used to describe prior pools merely for ease of reference and are not intended to limit or characterize the present disclosure.

"Panel Pools" are pools that consist only of panels that are either bolted together or constrained in some way by one or more bands, straps, or braces. The smallest of these may be built in square or rectangular shapes but most panel pools comprise more than four panels, arranged in some regular geometric shape that incorporates some sort of arch or circular form, such as a hexagon or an octagon. The horizontal length of the panels quickly becomes an issue because, as the panels get larger, they need to be exponentially stronger.

"Modular Pools" exhibit one of two basic traits: either they incorporate some sort of arch or they use a large number of fasteners and braces or buttresses. Many modular pools of significant size (e.g. larger than 20 feet) that have straight walls require some sort of external bracing or buttresses that requires a significant "foot print" area for the braces. For example, a 40-foot-long, 7-foot-wide lap pool with external wall braces would require approximately an extra 3 feet on each side for the braces and would therefore require almost double the floor space of the actual pool. As well, doubling the height of the pool would require a corresponding increase of the brace width (assuming a free standing pool), effectively tripling or quadrupling the required floor space.

"Single Panel Pools" are typically constructed with a single metal sheet that is set up as a circular wall and has some method of fastening the two ends together. Such pools are limited to circular shapes and therefore may be inefficient for swimming laps and may not be suitable for indoor use because structural failures tend to be catastrophic, i.e. a large volume of water may escape in a short time period.

"Rubber Sheet" or "Single Sheet Pools" primarily using a single component may be vulnerable to catastrophic failure. When used indoors, such pools are commonly seen installed in some sort of trench or secondary containment structure.

Certain other modular pools have complicated designs that use high-precision parts and a large number of fasteners, for instance as many as a dozen bolts on a single joint. While these pools may be termed 'modular', moving, repairing and modifying such pools is likely difficult.

It is, therefore, desirable to provide an alternative modular pool system and components therefore.

SUMMARY

It is an object of the present disclosure to provide an alternative modular pool system, and components therefor.

In a first aspect, the present disclosure provides a pool bracket for use in assembling a pool frame for a pool, the pool bracket comprising: a lateral member for lying beneath the pool and for crossing a width of the pool; and two vertical beams, each extending, in use, vertically upward from the lateral member outside of the width of the pool, on each side of the pool, each vertical beam having a vertical support member receptor for receiving a vertical support member.

In an embodiment, the pool bracket comprises one vertical beam.

In an embodiment, the pool bracket comprises one integrally formed piece.

In a second aspect, the present disclosure provides a pool bracket for use in assembling a pool frame for a pool, the pool bracket comprising: a lateral member for lying beneath the pool and for crossing a width of the pool; and two brackets, each comprising a side extending vertically upwards from the lateral member outside of the width of the pool, on each side of the pool.

In a third aspect, the present disclosure provides a pool wall panel for use in assembling pool walls for a pool, the pool wall panel comprising: an insert for receiving components, a first seal for mating with a wall, and a second seal for mating with another wall.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Figure 1:
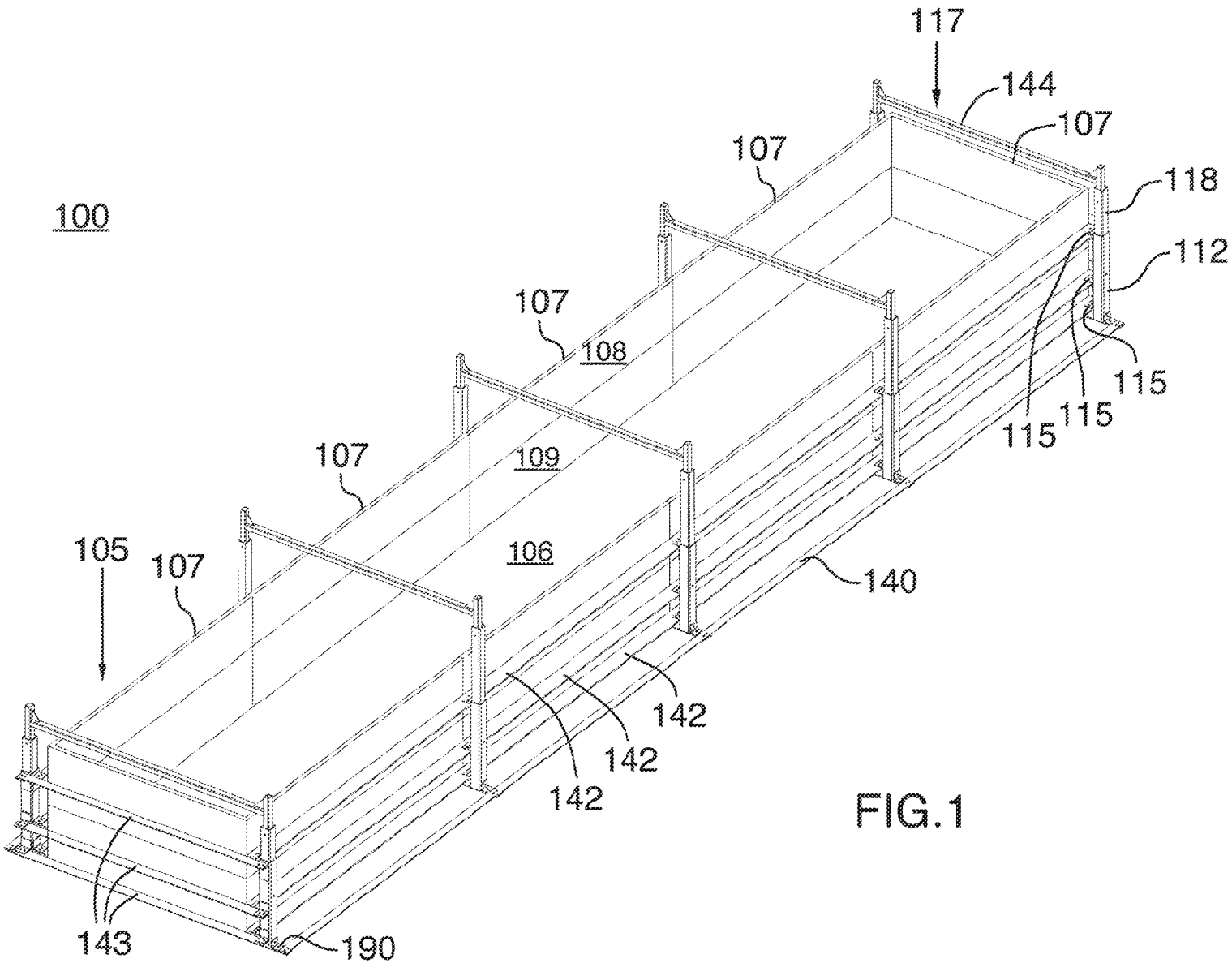
FIG. 1 is a top perspective view of a modular pool having a pool frame constructed from wrap around brackets, described herein.

For the purpose of promoting an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. It will be apparent to those skilled in the relevant art that some features that are not relevant to the present disclosure may not be shown in the drawings for the sake of clarity.

At the outset, for ease of reference, certain terms used in this application and their meaning as used in this context are set forth below. To the extent a term used herein is not defined below, it should be given the broadest definition persons in the pertinent art have given that term as reflected in at least one printed publication or issued patent. Further, the present processes are not limited by the usage of the terms shown below, as all equivalents, synonyms, new developments and terms or processes that serve the same or a similar purpose are considered to be within the scope of the present disclosure.

The terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

In an aspect, disclosed herein is a pool bracket for use in assembling a pool frame for a pool, the pool bracket comprising a lateral member for lying beneath the pool and for crossing a width of the pool; and two vertical beams, each extending, in use, vertically upward from the lateral member outside of the width of the pool, on each side of the pool, each vertical beam having a vertical support member receptor for receiving a vertical support member.

In an embodiment, the pool bracket comprises one vertical beam.

In an embodiment, the vertical beam is a hollow square tube.

In an embodiment, the vertical beam is a hollow circular tube.

In an embodiment, the vertical beam is an I-beam.

In an aspect, disclosed herein is a pool frame for a pool comprising a plurality of pool brackets as defined herein, arranged in series and parallel to one another; and longitudinal side members connecting adjacent brackets along a longitudinal side of the pool.

In an embodiment, the pool frame further comprises vertical support members received by each of the vertical support member receptors and extending above a height of the pool.

In an embodiment, the pool frame further comprises connectors connecting each of the vertical support members, spanning the width of the pool across each pool bracket at a height above a water level and along the longitudinal sides of the pool.

In an embodiment, the pool frame further comprises a plurality of wall panels held in place by the plurality of brackets and longitudinal side members forming a pool shape wherein at least one wall panel comprises a pool panel.

In an aspect, disclosed herein is a kit for a pool bracket for assembling a pool frame for a pool, the kit comprising at least one lateral member for lying beneath the pool and for crossing a width of the pool; at least two vertical beams, each extending, in use, vertically upward from the lateral member on each side of the lateral member; and, each vertical beam having a vertical support member receptor.

In an embodiment, the kit further comprises at least two longitudinal side members for connecting adjacent pool brackets; at least two vertical support members, dimensioned to extend above a height of the pool and be received by the vertical support member receptors; and at least one connector, dimensioned to span the width of the pool, and for connecting a pair of the at least two vertical support members.

In an embodiment, disclosed herein is a pool comprising a pool frame as described herein; and a plurality of wall panels held in place by the pool frame forming a pool shape wherein at least one wall panel comprises a pool panel.

In an embodiment, a pool as disclosed herein further comprising a pool liner disposed on a pool side of the wall panels.

In an aspect, disclosed herein is a pool bracket for use in assembling a pool frame for a pool, the pool bracket comprising: a lateral member for lying beneath the pool and for crossing a width of the pool; and two brackets, each having a side extending, in use, vertically upward from the lateral member outside of the width of the pool, on each side of the pool.

In an aspect, disclosed herein is a pool bracket for use in assembling a pool frame for a pool, the pool bracket comprising a lateral member for lying beneath the pool and for crossing a width of the pool; and two vertical beams, each extending, in use, vertically upward from the lateral member outside of the width of the pool, on each side of the pool, each vertical beam extending above a surface height of the pool.

In an embodiment, the pool bracket comprises one vertical beam.

In an embodiment, the vertical beam is a hollow square tube.

In an embodiment, the vertical beam is a hollow circular tube.

In an embodiment, the vertical beam is an I-beam.

In an aspect, disclosed herein is a pool frame for a pool comprising a plurality of pool brackets as defined herein, arranged in series and parallel to one another; and longitudinal side members connecting adjacent brackets along a longitudinal side of the pool.

In an embodiment, the pool frame further comprises connectors connecting each of the vertical beams, spanning the width of the pool across each pool bracket at a height above a water level.

In an embodiment, the pool frame further comprises connectors connecting each of the vertical beams along the longitudinal sides of the pool.

In an aspect, disclosed herein is a kit for assembling a pool frame for a pool comprising at least one lateral member as defined herein; and at least two vertical beams as defined herein.

In an embodiment, the kit further comprises longitudinal side members as disclosed herein; and connectors as defined herein.

In an aspect, disclosed herein is a pool comprising a pool frame as disclosed herein; and a plurality of wall panels held in place by the pool frame and forming a pool shape.

In an embodiment, the wall panels further comprise pool panels.

In an embodiment, the pool further comprises a pool liner disposed on a pool side of the wall panels.

Generally, the present disclosure provides pool brackets for use in assembling a pool frame for a pool. The pool brackets may be used as a primary building block for constructing custom sized and shaped free-standing semi-rigid pools, including without limitation, lap-pools, cuboid pools, portable outdoor pools, semi-portable, and indoor pools. Also described are pool frames, pools, wall panels, and kits for assembling pool brackets, pool frames, and pools. Wall panels may further include pool panels which may comprise inserts for installing other components such as water ports, lights, sensors, or power sources. The wall panels may be replaceable even while the pool retains water.

The present disclosure is not limited to any one particular set of pool dimensions (e.g., height, width, length).

Water exerts stress against walls and frames of pools, changing in magnitude with depth. At the water surface, water exerts minimal loads against the walls and frame of the pool relative to the more significant loads exerted against the bottom of the pool. As such, the height of a pool, and by extension it's frame and wall components can be categorized as "trivial" or "non-trivial", where the "non-trivial" components are designed to bear greater loads exerted by the water.

For example, pools having a depth of water less than 24" are generally understood to be classified as having a "trivial" depth of water. In this sense, the lower total volume of water typically contained by a shallower depth pool greatly reduces stress loads exerted against the walls of a pool and the frame supporting the pool, such that the exerted stresses may be considered trivial. Conversely, pools supporting a depth of water greater than 24" may be classified to also contain a "non-trivial" depth of water. Generally, the topmost 24" of water depth in a pool are considered trivial, any water below this depth may be non-trivial. For a pool containing four feet of water for example, the bottom two feet of water may be considered "non-trivial" and the top two feet of water may be considered "trivial". While the present disclosure is not limited to only one classification of pools, reference may be made to pools as being conceptually divided into "trivial" aspects and "non-trivial" aspects in relation to the depth of water.

Described is a pool bracket for use in assembling a pool frame for a semi-rigid pool, the pool bracket comprising: a lateral member for lying beneath the pool and for crossing a width of the pool; and one or two vertical beams, each extending, in use, vertically upward from the lateral member outside of the width of the pool, on each side of the pool, each vertical beam having a vertical support member receptor for receiving a vertical support member. The lateral member may be any suitable lateral member, and is illustrated in the Figures as a ¼ inch steel strap. The vertical beams may be any suitable vertical beam and are generally illustrated as ⅜" inch thick square tubes. The vertical support member receptors may be any suitable vertical support member receptors, and are illustrated in the Figures as the interior of the vertical beams itself. Vertical support member receptors without limitation, may comprise hollow tubes attached or integrally formed with the exterior of the vertical beams.

FIG. 1 illustrates a modular pool 100 having a frame comprising a plurality of wrap-around brackets as described herein. The modular pool 100 may comprise pool wall 105, liner (not shown) and a plurality of wrap-around brackets. The wrap-around brackets are arranged in series, parallel to one another, with longitudinal side members 140 connecting adjacent brackets. The brackets may comprise two vertical beams 112, placed on opposite sides of the pool 100, connected by a lateral member (not shown) running underneath the bottom surface of the pool. A vertical support member 118 is connected to each vertical beam 112, extending vertically upwardly above the height of the pool 100. A connector 144 couples adjacent vertical support members 118. A top strap 117 may refer to the aforementioned combination of opposed vertical support members 118 and a connector 144. Pool wall 105 may comprise a pool floor 106 and a plurality of wall panels 107 where each wall panel 107 may further comprise a pool panel 108 and a lower panel 109. A plurality of longitudinal support members 142 may further attach to the wall panels 107 and angled tabs 115 of the bracket 111. A liner (not shown) may cover the inner surface of the pool 100.

Figure 2:
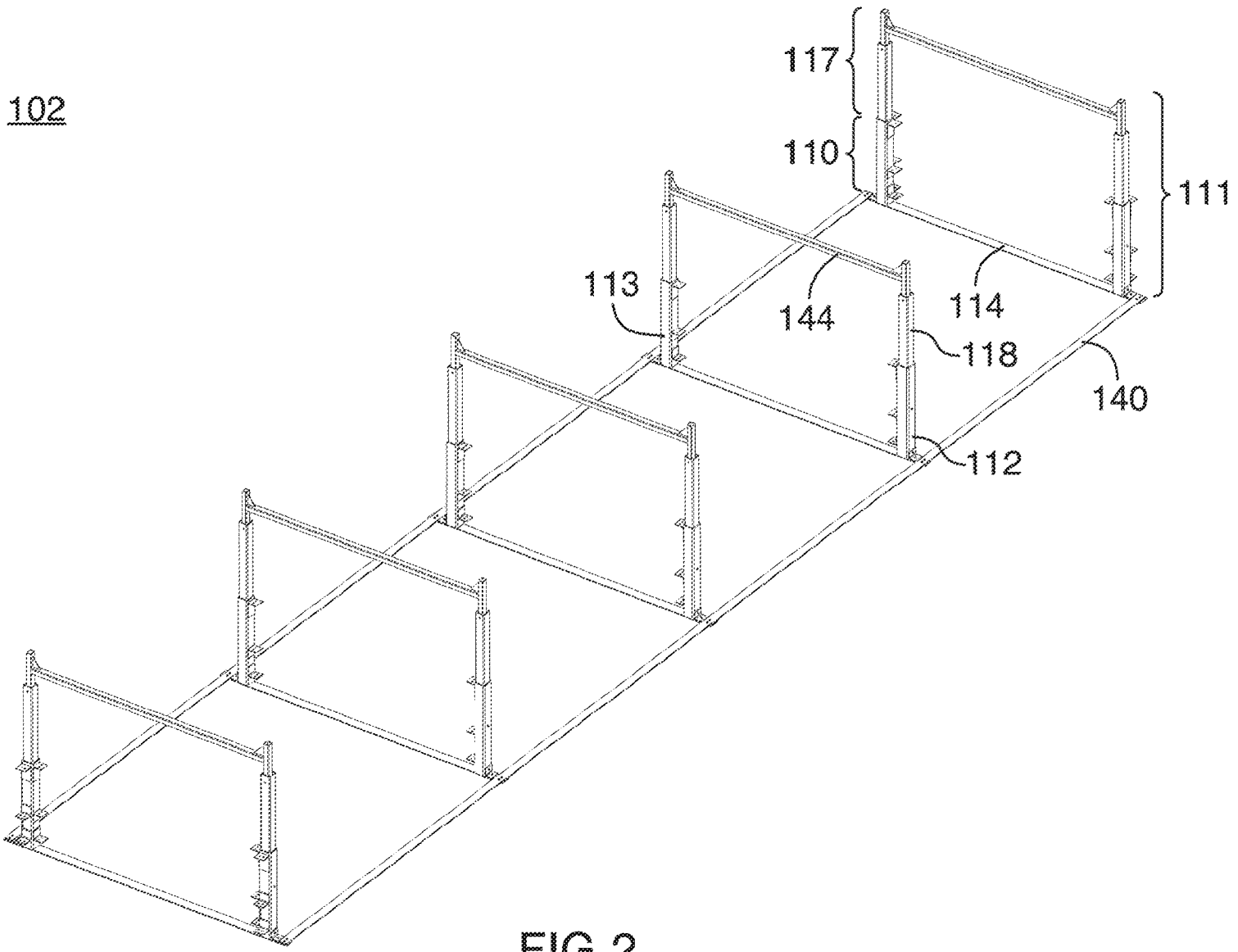
FIG. 2 is a top perspective view of a pool frame comprising a plurality of wrap around brackets connected in series and in parallel.
Figure 3:
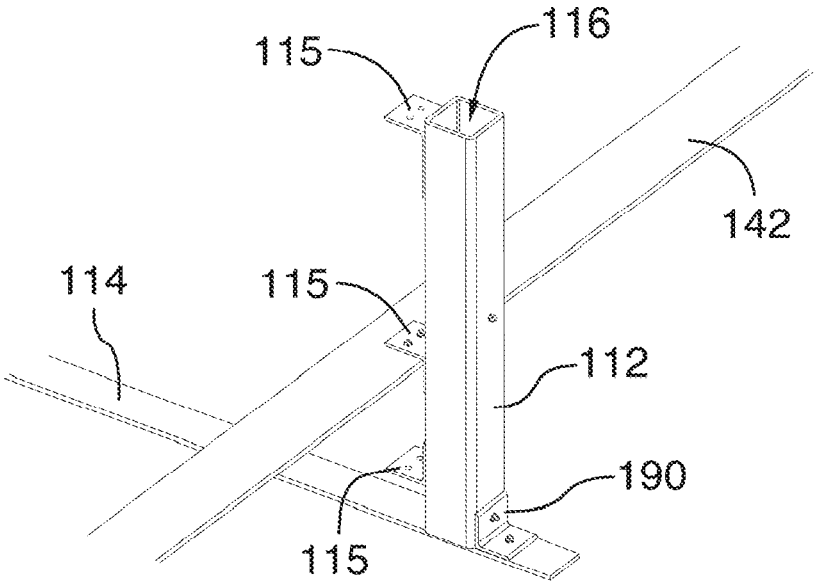
FIG. 3 is a perspective view of a pool bracket comprising a vertical beam, illustrated as a square hollow tube, and connected to a longitudinal side member.
Figure 4:
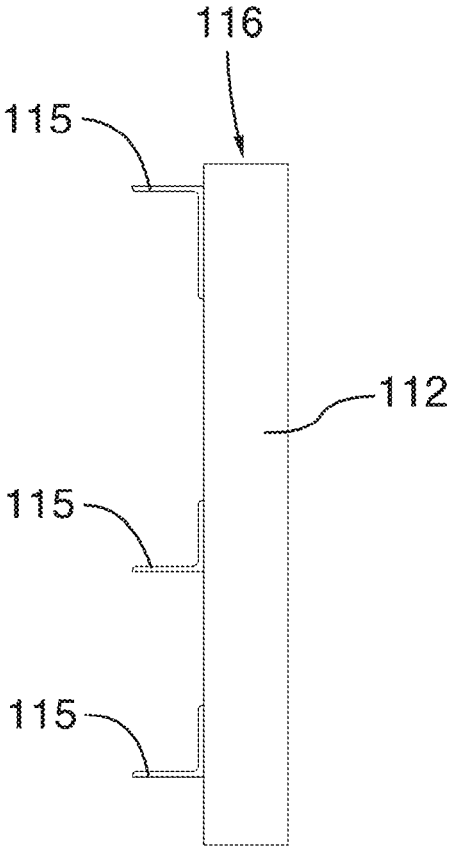
FIG. 4 is a side elevation view of the vertical beam illustrated in FIG. 3.
Figure 5:
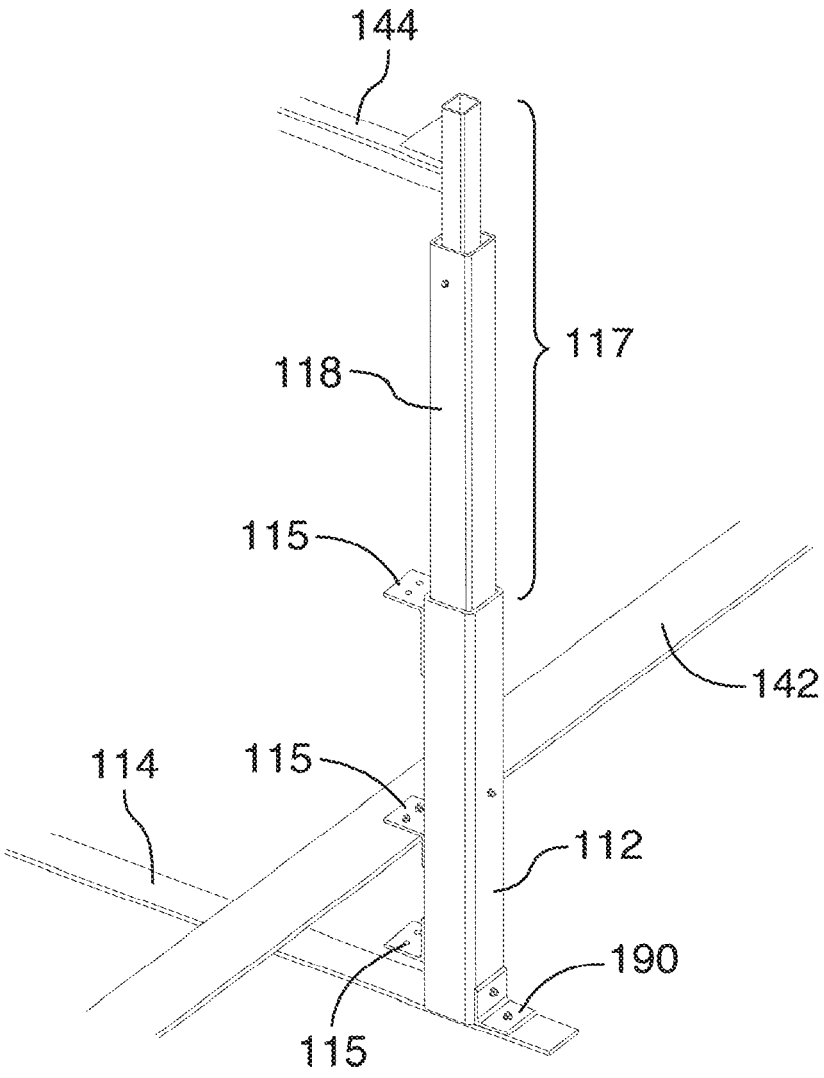
FIG. 5 is a perspective view of part of a wrap-around bracket connected to a longitudinal side member.

FIG. 2 illustrates a pool frame 102. The frame 102 may comprise a plurality of wrap-around brackets 111 as defined herein. The brackets 111 are arranged in series and parallel to one another with longitudinal side members 140 connecting adjacent brackets 111. The wrap-around bracket 111 may comprise a lower portion or pool bracket 110 connected with an upper portion or top strap 117. The longitudinal side members 140 may be any suitable longitudinal side members 140, and are illustrated as ¼ inch steel straps running along the ground. As shown in FIG. 3, pool bracket 110 may further comprise angled tabs 115 (or other fastening means known in the art) to connect with longitudinal support members 142. As shown in FIG. 5, top strap 117 may further comprise vertical support members 118 and connector 144. Vertical support member 118 extends vertically above a height of the pool and is received by a vertical support member receptors 116 which is illustrated as the hollow interior of vertical beam 112. Vertical support members 118 may be any suitable vertical support members 118, and are illustrated in the photographs as posts. Connectors 144 connect each of the vertical support members 118, spanning the width of the pool across each pool bracket 110 at a height above water level. Additional connectors (not shown) may connect together vertical support members 118 from other brackets 111. The connectors 144 may be any suitable connectors, and are illustrated in the Figures as inverted U-bars.

Figure 6:
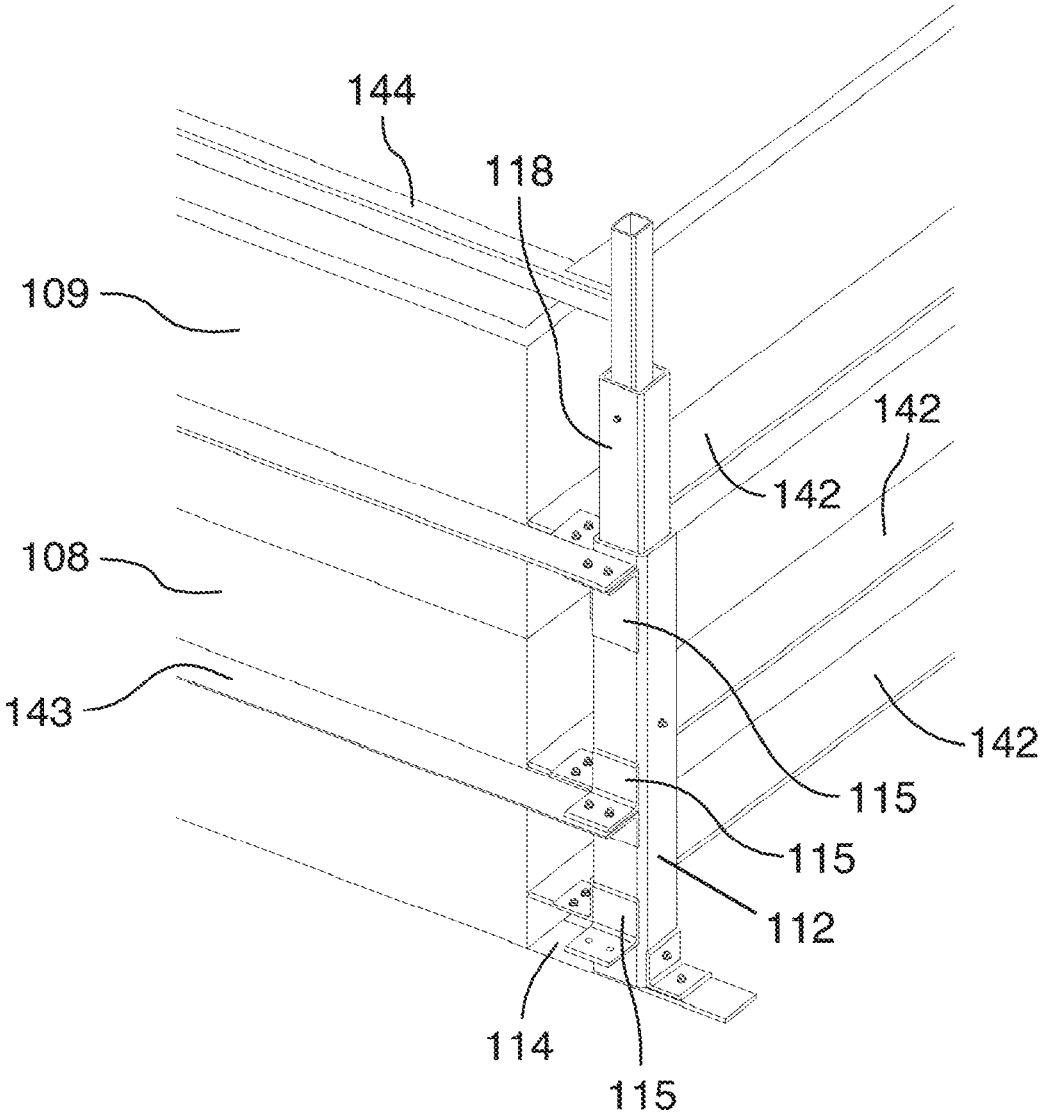
FIG. 6 is a close up perspective view of an end-corner of a modular pool as illustrated in FIG. 1.
Figure 7A:
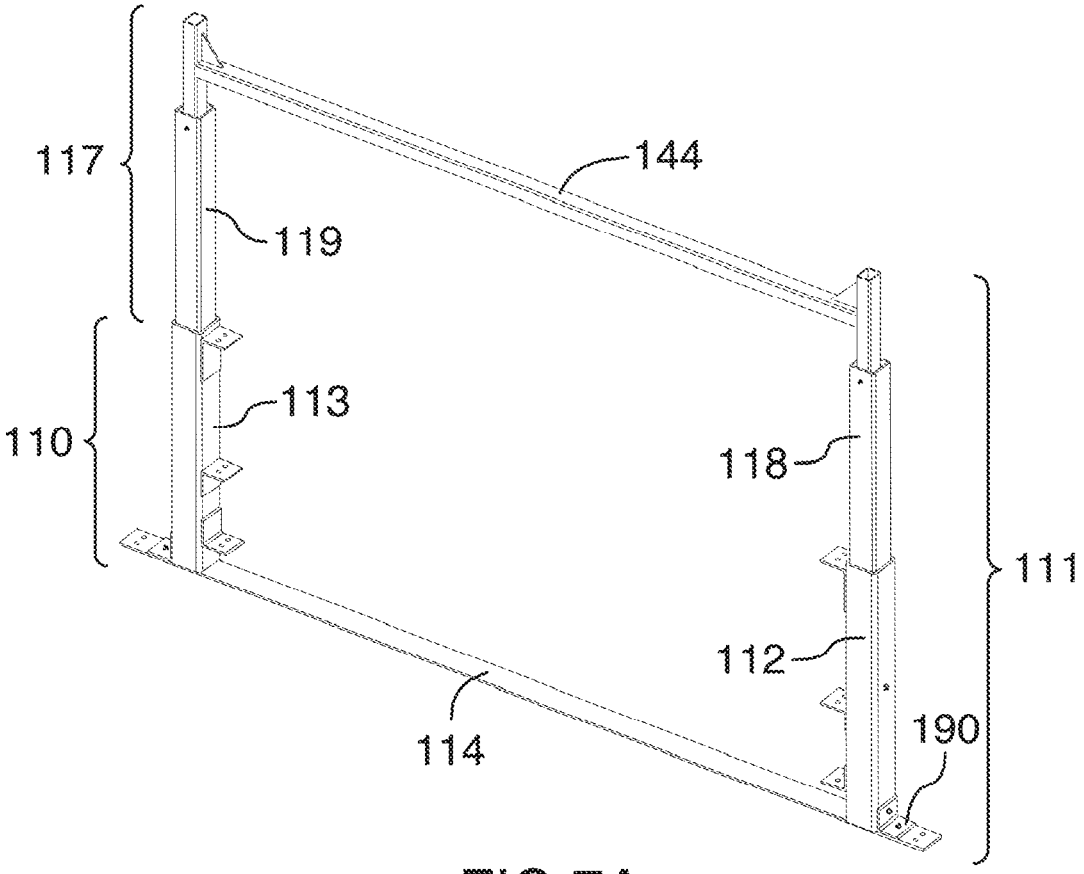
FIG. 7A is a top perspective view of a wrap-around bracket comprising a top strap and a pool bracket.
Figure 7B:
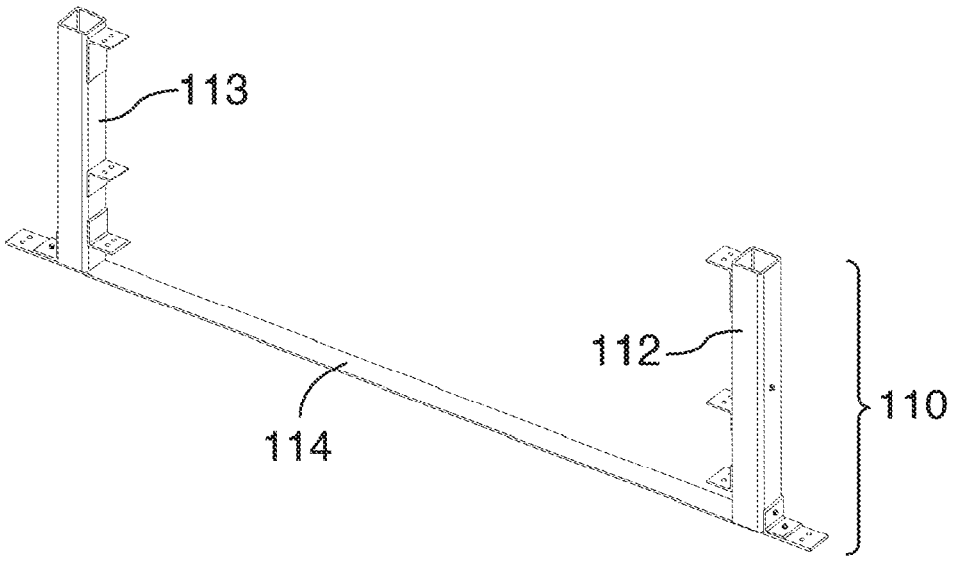
FIG. 7B is a perspective view of a pool bracket.

FIG. 6 illustrates a close up of a wrap-around bracket 111 located at an end wall of a pool. Vertical beam 112 is illustrated with three angle tabs 115 for connecting with longitudinal support member 142, and three additional angle tabs 115 for connecting with lateral support members 143. Lateral support members 143 run along the width of an end wall, connecting to an opposed vertical beam and its corresponding angle tabs. One or more lateral support members 143 may be included to provide additional reinforcement along the end wall. Some pool widths may not include any lateral support members 143.

A kit may comprise at least one lateral member 114 as defined herein; at least two vertical beams 112 as defined herein; and at least two vertical support member receptors as defined herein 116. The kit may further comprise longitudinal side members 140 as defined herein, vertical support members 118 as defined herein; and connectors 144 as defined herein.

A pool 100 may comprise a pool frame 102 as defined herein, and a pool wall 105. Pool wall 105 may comprise a pool floor 106 a plurality of wall panels 107, held in place by the pool frame 102, and forming a pool shape. The pool 100 may further comprise a pool liner (not shown) disposed on a pool side, or interior side of the pool wall 105.

Figure 8A:
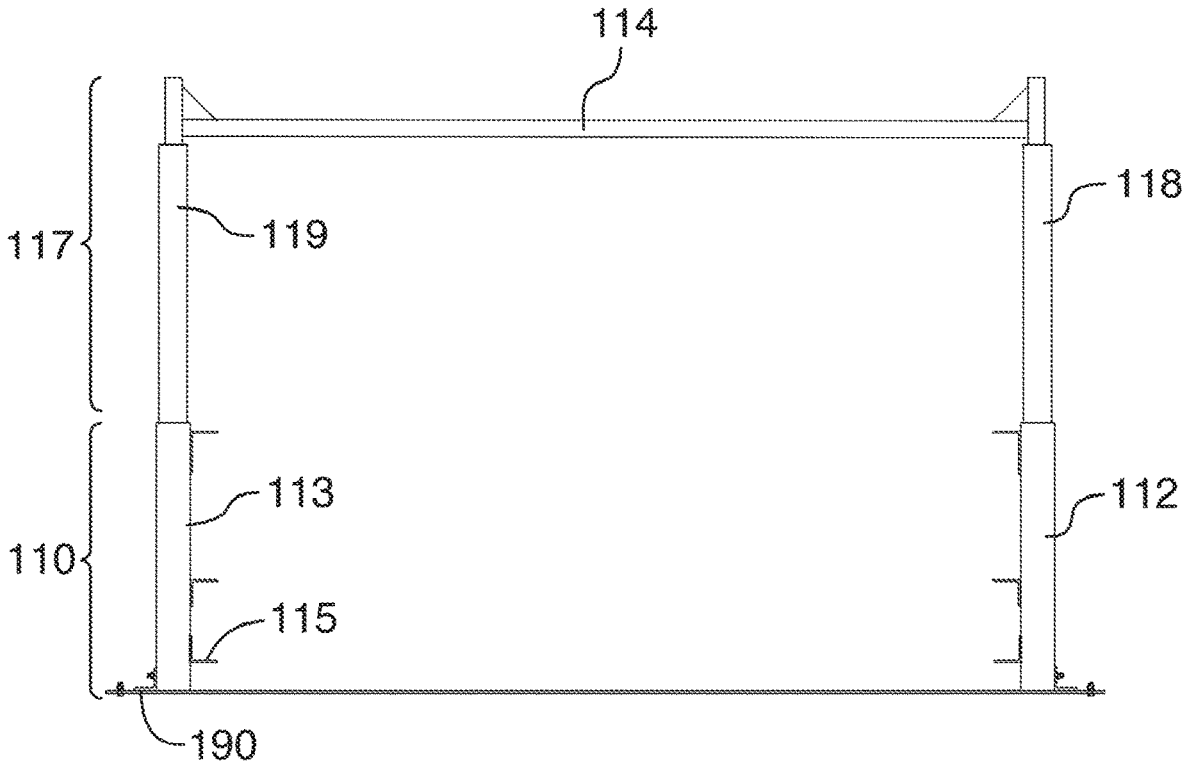
FIG. 8A is a front elevation view of the wrap-around bracket illustrated in FIG. 7A.
Figure 8B:
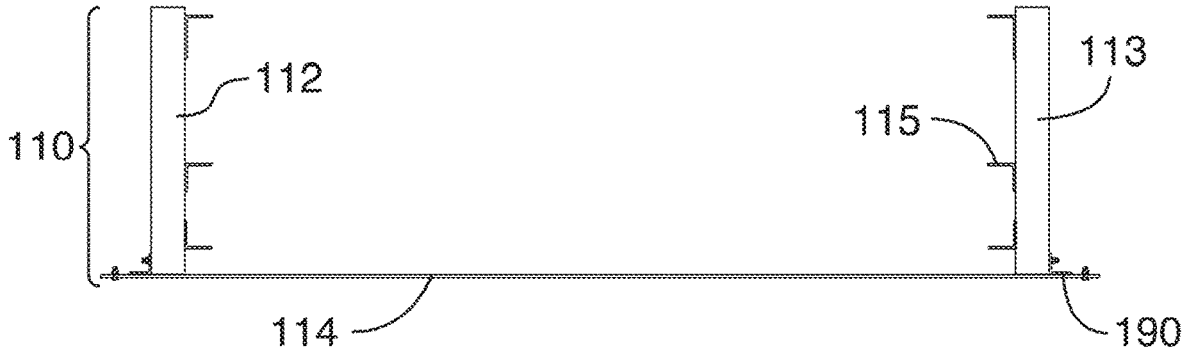
FIG. 8B is a front elevation view of the pool bracket illustrated in FIG. 7B.
Figure 9:
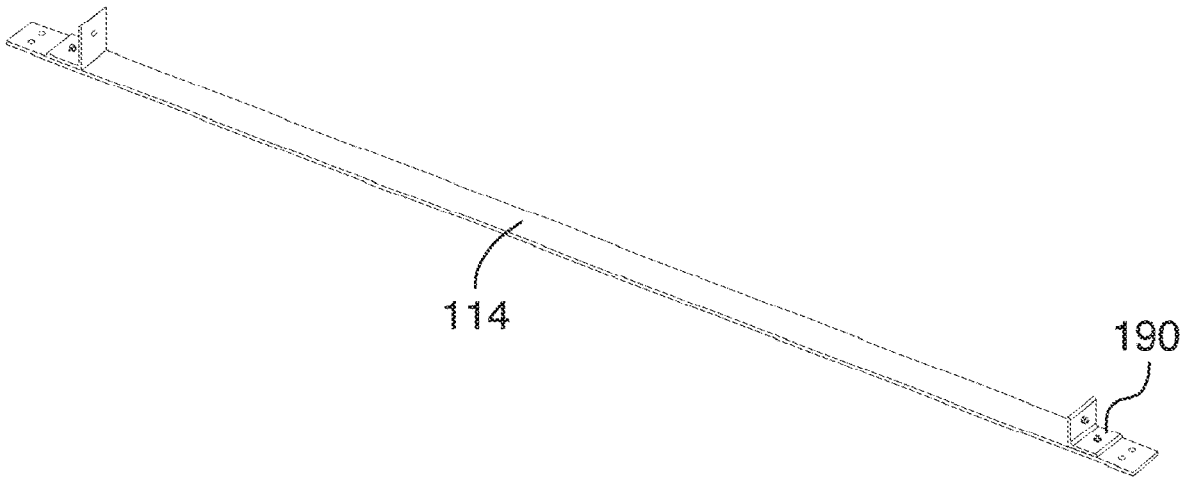
FIG. 9 is a top perspective view of a pool bracket comprising two angled tabs.

A 2-directional bottom corner frame component (2d-BCFC) 110 herein generally refers to the combination of a pair of opposed vertical beams 112 and a lateral member 114 connecting them. However, a minimal 2d-BCFC 180 (FIG. 9), comprising a lateral member 114 and angle brackets 190 may be used for trivial pool designs. A 2d-BCFC 110 is used as a primary building block for constructing free-standing rectangular cuboid swimming pools. The term "corner" is used in this context to mean where a pool frame bottom meets the pool frame side walls. The term "2d" is used to generally refer to force exerted in two opposing directions along the same axis; most of 2d-BCFC's 110 strength and functionality is aligned along the cross-pool axis. The vertical beams 112 are each designed to maximize strength in one direction. Solidly joining a pair of opposed vertical beams 112 with a lateral member 114 gives stability in both directions along the axis traversed by the lateral member 114. As such, a 2d-BCFC 110 strongly and competently resists force pushing against a first vertical beam 112 by having a lateral member connected to an opposed second vertical beam 113, the second vertical beam 113 opposing forces against the first vertical beam 112, and vice-versa, as illustrated in FIGS. 8A and 8B.

Non-trivial pools typically require a pool frame 102 constructed of elements in addition to a 2d-BCFC 110. A non-trivial cuboid swimming pool (where "cuboid" is understood in the context of "rubber-sheet" geometries, for example a cube is a cuboid and so is an American football) may be built using a wrap-around bracket 111 having structural component(s) above the surface of the water. The additional set of components connected to a 2d-BCFC 110 generally refers to the top strap 117 which may include two vertical support members 118 and a connector 144. The top strap 117 may also comprise a connector 144 only, for example and without limitation, when vertical beams 112 of a 2d-BCFC 110 extend above a height of the surface of the pool, top strap 117 may comprise a connector 144.

The vertical beams 112 of a 2d-BCFC 110 may comprise a vertical support member receptor 116 for receiving a vertical support member 118 of a top strap 117. The vertical beams 112 may be square hollow tubes where the hollow interior defines a vertical support member receptor 116 for receiving a vertical support member 118 that has been sized and shaped to mate with the receptor 116. The vertical support member 118 may be further affixed to the vertical beam 112 using any well known means, for example by fastening both members together with a ⅜" steel bolt. When assembled, the 2d-BCFC 110 and top strap 117 comprise a wrap-around bracket 111 which circumscribes a cross-sectional width of the pool. A pool frame 102 can thus comprise a plurality of brackets 111 arranged in series and parallel to one another; and longitudinal side members 140 connecting adjacent brackets 111.

In the case of an opposite force that pushes a vertical beam 112 outwards from the pool, the top strap 117 pulls against the opposite vertical beam 112, and once again is met by great resistance. Wrap-around brackets 111 provide a small amount of long-axis (longitudinal) stabilization but the salient point is that such stability is the sum result of all of the brackets 111; for example if there are ten brackets 111 in a pool 100 then each bracket 111 has only to supply 1/10th as much stability in the longitudinal axis as in the cross-pool (lateral) axis. In practical implementations, the cross bracket stability or rotational resistance need be only 1/20th or perhaps even as low as 1/50th the strength in the lateral axis. The brackets 111 are not required to provide multi-directional stabilization on each vertical beam 112.

By way of example, the 2d-BCFC 110 may be used to construct on-slab (or possibly on level grade) freestanding lap pools which are generally dimensioned having a non-trivial depth and width ranging from 1.5 m to 2.5 m wide, and a length of 25 m to 50 m. However, the pool brackets disclosed herein are not limited to constructing a pool frame 102 for supporting a lap pool according to the aforementioned dimensions. For instance, a lap pool of length less than 25 m or of virtually unlimited length may be supported by a pool frame constructed with the pool bracket(s) disclosed herein. While wider pools may be assembled, limiting the width may allow ease of transport, for instance by a single person, using pieces less than 2 m long and weighing less than 50 lbs., or having a packaged length of less than 3 m and less than 100 lbs. weight.

The 2d-BCFC 110 may be used to construct cuboid pools with asymmetrical frames optimized to reflect the asymmetrical loads created by water stored in containers. In swimming pools for example, there is a large static unidirectional outward hydraulic force exerted at the bottom of the pool which decreases linearly to zero at the top of the pool. An asymmetrical pool frame can exploit this distribution of force by implementing for example a 2d-BCFC 110 for supporting the large static unidirectional force exerted at the bottom of the pool and further integrating a top strap 117 for opposing reduced stress loads exerted at higher pool elevations. In other words, the 2d-BCFC 110 may extend vertically to span the depth of water considered non-trivial.

Traditionally, non-trivial pools have implemented external wall braces, greatly contributing to the pool's footprint. In some instances, the footprint of the pool has doubled as result of external braces. With reference to FIG. 1, a top strap 117 connects opposed vertical beams 112 so that each vertical beam 112 actually supports the opposite wall, eliminating the need for external bracing and resulting in a pool footprint practically the same as the surface of the pool where the pool sits evenly on the floor without pressure points. The vertical dimension of the brace was able to be reduced, for instance down to a ¼" steel strap.

The 2d-BCFC 110 is designed to facilitate a fast and easy pool assembly by incorporating into itself the majority or all of the non-shear connections. In other words, all of the remaining connections in the pools are subject primarily to shear forces, and otherwise experience a nominal degree of non-shear stress, and they can therefore be bolts, pins, or other fasteners that do not require special tools or skills for installation.

The 2d-BCFC 110 is designed having a large safety margin of excess strength, and may be designed to withstand 2× the maximum load or more so as to minimize the risk of catastrophic failure. For most pools, it is very unlikely that a leak or combination of leaks will be large enough to overwhelm any typical gravity-fed drainage system such as a 4" sewer drain.

The 2d-BCFC 110 may be used repeatedly at intervals along the bottom edges of the pool frame. The 2d-BCFC 110 may comprise two vertical beams 112 welded to a steel lateral member 114, but it may also have other components such as tubes, channels, bars, plates, pins etc.

The 2d-BCFC 110 is designed so as to incorporate into itself all of the essential manufacturing processes and engineering processes that are required to build entire frames for cuboid swimming pools. The remaining frame components can be stock materials perhaps with a minimal amount of mounting holes that are simple enough to be made at the building site, if so desired by the builder. However, as will be appreciated by persons skilled in the art, pool environments expose many components to water and accordingly, materials resistant to water corrosion or treated with water corrosion resistant finishes may be used.

Consider a non-limiting illustrative example of a pool 100 according to FIG. 1. The pool 100 may be dimensioned 32 feet in length, 7 feet in width, and 4 feet in height. The length of the pool comprises four 8-foot wide wall panels 107 on each side, and one four foot wide wall panel 107, for each end wall. The wall panels 107 each comprise a pool panel 109 and a lower panel 108. The frame 102 comprises five wrap-around brackets 111, each bracket 111 comprising a 2d-BCFC 110 and top strap 117. The brackets 111 are situated at the joint of each interconnected wall panel 107 and adjacent brackets 111 are connected together by side members 140 and support members 142. Accordingly, FIG. 3 discloses a vertical beam 112 of a 2d-BCFC 110 for use in such a pool. Vertical beam 112 is formed of a sufficiently strong material such as steel. The vertical beam 112 may be a square hollow tube defined by four vertical side walls. As an illustrative example, each vertical side wall could be 3.5" wide and 3/16" thick. The square hollow interior defined by the side walls acts as a vertical support member receptor 116 for receiving a vertical support member 118 (not shown in FIG. 3). As such, vertical support member 118 could be dimensioned with four vertical side walls, each 3" wide and 3/16" thick, thereby sized and shaped to leave a 1/8" gap in receptor 116 when mated therewith. Vertical beam 112 and support member 118 can further affix together by numerous methods known in the art, including fastening together with a 3/8" steel bolt. Vertical beam 112 may further include a vertical support member receptor 116 connected to an exterior of vertical beam 112.

Figure 10:
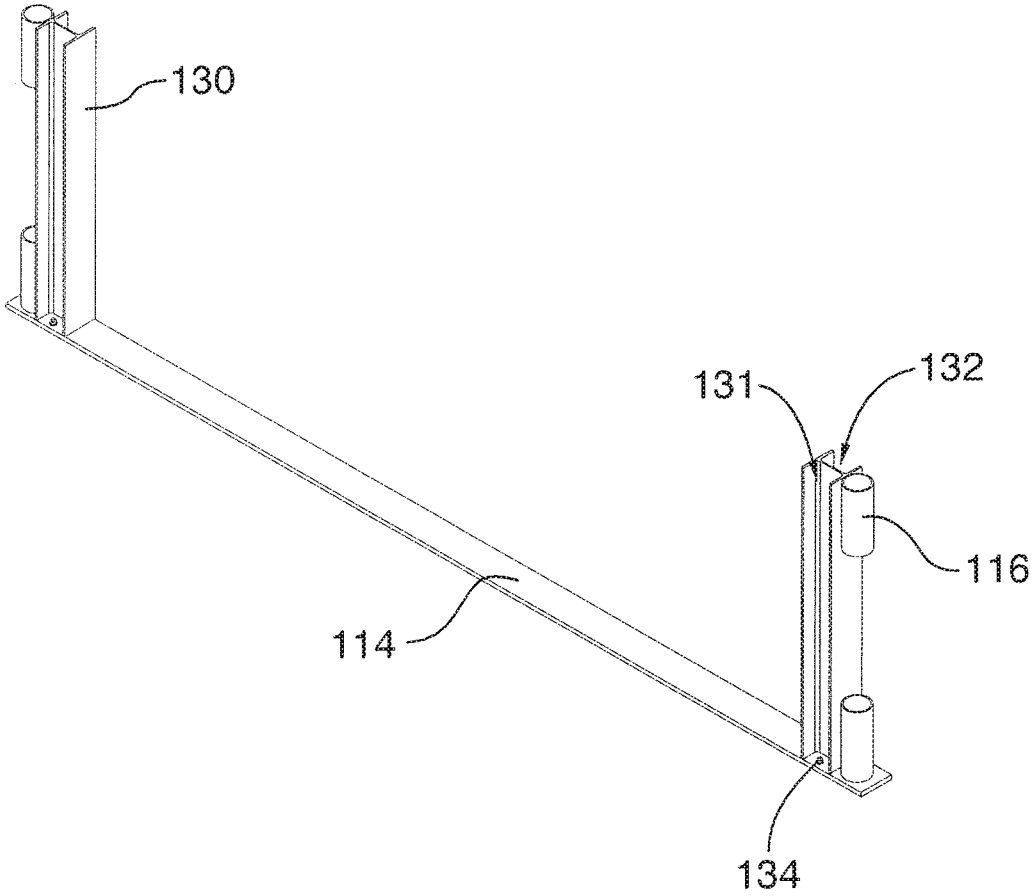
FIG. 10 is a perspective view of a pool bracket comprising two vertical beams, illustrated as I-beams.

Vertical beams 112 may comprise different shapes and configurations. For example, vertical beam 112 may comprise a hollow circular tube. A circular tube may not however oppose non-shear forces as efficiently as a square hollow tube and thus may require sturdier dimensions, for example the circular tube may require walls thicker than 3/16". As shown in FIG. 10, vertical beams 112 may comprise an I-Beam 130. I-Beam 130 may comprise a first recess 131 and a second recess 132. Without limitation, each recess may be sized and shaped for receiving a wall panel 107 and to provide a tight fit therewith. Lateral member 114 may further comprise a plurality of connections 134. Each connection 134, illustrated in FIG. 10 as pins, may be situated in each recess and provide connectivity with and restraint for wall panels 107. The I-Beams 130 may be welded to lateral member 114 along all internal and external edges. A vertical support member receptor 116 may be welded to the exterior of each I-Beam. FIG. 10 illustrates four such receptors 116, two welded to the exterior of each I-Beam 130. The receptors are illustrated as hollow circular tubes but may be any suitable vertical support member receptor, including square hollow tubes. An I-Beam design may not oppose non-shear forces as efficiently as a square hollow tube and thus may require sturdier dimensions, for example the I-Beam 130 may require walls thicker than 1/4".

Vertical beam 112 may be welded to lateral member 114 and further affixed thereto by fastening—or other well known techniques—with angle bracket 190. Angle bracket 190 may be connected to lateral member 114 by any well known means including welding. Angle bracket 190 may also be integrally formed with lateral member 114. Angle bracket 190 is illustrated as connecting to member 114 by fastening with a bolt, in addition to being welded thereto.

Vertical beam 112 may be designed to extend vertically in height to span the non-trivial depth of water contained in a pool. For a pool containing four feet of water it may have a non-trivial depth of two feet and vertical beam 112 may have an approximate height of two feet. However, the height of vertical beam 112 will ultimately depend on a number of factors, including the thickness of lower panel 108, the width of the pool 100, the width of the wall panels 107, and the material and thickness of vertical beam 112. Vertical beam 112 may be designed having a height extending to the top surface of the pool. Vertical beam 112 may also have a height extending above a surface of the pool.

Increasing the height of vertical beam 112 may correspond to reduced design requirements for wrap-around brackets 111. For example, where vertical beam 112 extends vertically above a surface of the pool, connector 144 may extend above and across the width of the pool to connect opposed vertical beams 112, thereby providing a wrap-around bracket 111 without vertical support members 118.

Additional lateral reinforcements may be required to adequately support loads exerted against wall panels 107. Lower panels 108 may extend in height to span all or most of the non-trivial depth of water. For example, an 8-foot wide wall panel 107 may comprise an 8 foot wide lower panel 108 supported by one or more longitudinal support members 142 connected to vertical beam 112. Vertical beam 112 may include one or more angle tabs 115 which connect to longitudinal support members 142. Support members 142 could be angled and comprise a vertical side and horizontal side where the vertical side connects with wall panel 107 and the horizontal side connects with an angle tab 115 of a vertical beam 112. For an 8-foot wide wall panel 107, it may have up to three longitudinal support members 140 connecting lower panel 108 with each vertical beam 112. For a 4-foot wide wall panel 107, one longitudinal support member 142 may provide sufficient reinforcement to lower panel 108.

The foregoing example is non-limiting and illustrates one set of dimensions and configurations for a pool. Persons skilled in the art will appreciate many variations can be made to vertical beams 112 while maintaining a sufficiently strong 2d-BCFC 110 for opposing the significant stress loads experienced at non-trivial depths in pools.

Wall panels 107 dimensioned 4 feet tall by 8 feet wide may have pool panels 109 that are not connected to wrap-around bracket 111. The wall panels 107 may be constructed of various materials including wood. Wall panels 107 may be fastened with a minimum number of fasteners, including with fasteners that don't require the aid of any tools.

In accordance with the foregoing illustrative example, a 2d-BCFC 110 having 24" tall vertical beams 112 may comprise eleven parts welded together: one lateral member 114 with two angle brackets 190 (one at each end of the later member), two vertical beams 112 (one at each end of lateral member 114) wherein vertical beams 112 are square hollow tubes further affixed with the two angle brackets, and six angle tabs 115, three at each end, welded onto the vertical beams 112.

Longitudinal support members 142 may comprise different strengths and thicknesses, so as to optimally suit the pressures at their specific depths. In FIG. 1 for example, the longitudinal support members 142 are illustrated as one piece traversing the length of the pool. However, longitudinal support members 142 may be designed to span the width of wall panel 107. Accordingly, angled tabs 115 may be designed with two points of connection to attach with a longitudinal support member from either side of vertical beam 112. While it may seem counter-intuitive, the longitudinal support member 142 connected at the lowest point of elevation on vertical beam 112 is much less substantial, almost half the strength, than the second-highest longitudinal support member 142. Note that there is no special provision for cross-bracket stabilization, there is sufficient cross-bracket stability provided by angle tabs 115 and, if necessary, lower panels 108. In this example, lateral member 114 is bolted to the floor, but this is not a structural part of the pool, the pool is entirely free-standing, the bolt is used to minimize 'walking around' movement that may be experienced during an earthquake or other moments of significant load exerted against the frame of the pool.

Lateral member 114 of 2d-BCFC 110 may be designed to be able to flex a small amount to better absorb and dissipate any momentary mechanical shocks and strains. Designing either the lateral member 114 or other components of the 2d-BCFC 110 with limited flexibility may greatly reduce material costs, as flexibility may absorb momentary shocks by transmitting and dispersing the shocks (and other loads) more efficiently.

2d-BCFC 110 may be the only pool frame component that requires non-trivial manufacturing processes.

2d-BCFC 110 may comprise one or two vertical beams 112 strongly joined together, for instance welded or bolted (or both) to lateral member 114.

Each vertical beam 112 may further comprise multiple components such as tubes, channels, bars, plates, pins, receptacles, supports, etc. The receptacles 116 may hold vertical support members 118. The supports may comprise angle brackets 115 for supporting and attaching to wall panels 107 or other support mechanisms for providing tensile strength to wall panels 107 or framing to support wall panels 107 above the vertical height of vertical beams 112 to provide strength and reinforcement along the higher portions of wall panels 107.

2d-BCFC 110 may operate in isolation to provide all cross-pool structural strength and stability.

A plurality of 2d-BCFC 110 may operate in unison to provide along-pool (longitudinal) structural strength and stability.

2d-BCFC 110 may provide support for floor attachment, where required.

Pools constructed with a frame in accordance with the brackets disclosed herein may be easy to ship, assemble, modify, and maintain as well as being easily adapted to a variety of installation situations, such as in-ground or above-ground, indoors or outdoors, exposed or enclosed, on-grade or on-slab and even mobile. The pools may be double-walled, with hard walls made of panels and a plastic or vinyl pool liner.

In contrast to the "Panel Pools" described in the background, certain pools described herein may be built in various shapes (the most typical may be rectangular for swimming laps), and may be expanded in length without requiring any additional strengthening of the panels. A 100 foot long pool may be built with the same panels and structural components as a 20 foot long pool.

In contrast to the "Modular pools" described in the background, certain pools described herein may be free standing, using a wrap-around frame, adding only a nominal increase to the floor space footprint of the pool itself, regardless of the size and height of the pool, and significantly reducing non-shear stresses exerted against the pool walls by instead distributing such forces against the brackets of the wrap-around frame.

Figure 11A:
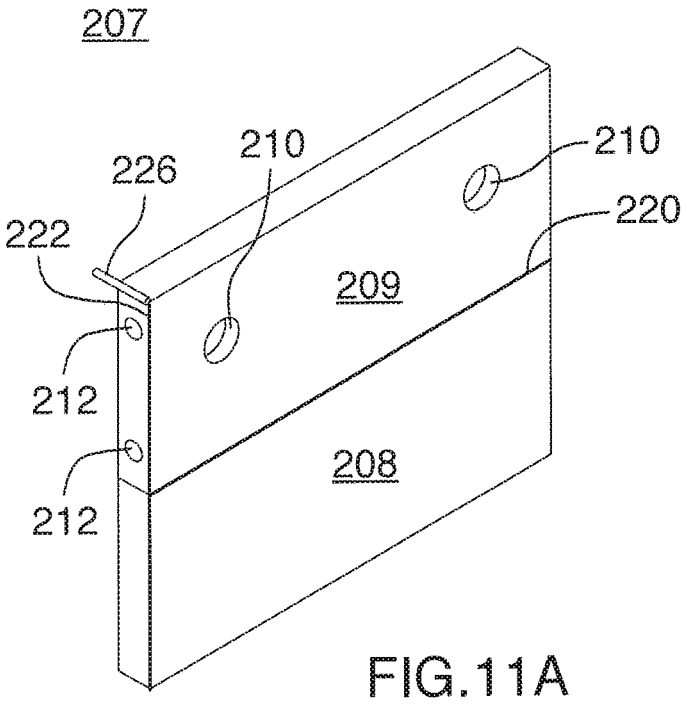
FIG. 11A is a perspective view of a wall panel comprising a pool panel and a lower panel as seen from an interior side (e.g. inside of pool) of the wall panel.

As illustrated in FIG. 11A, a plurality of wall panels 207 may be used to assemble the side walls, end walls, and flooring of a swimming pool, for example for use as the pool floor 106 and wall panels 107 illustrated in FIG. 1.

Wall panels 207 may further comprise sub-panels, including without limitation pool panel 209 or lower panel 208 or both pool panel 209 and lower panel 208. Wall panels 207 may comprise active and/or passive operational components.

Wall panel 207 may be an extensible platform to enable modular pool interfacing. Wall panel 207 may be adapted as needed.

Without limitation, a plurality of wall panels 207 may be assembled with asymmetric frames, wrap-around brackets 111, pool brackets 110, and/or minimal 2d-BCFC 180 as described herein, for constructing "cuboid-type" modular pools. Wall panel 207 may also be used on any pool with rigid walls.

Wall panel 207 may comprise, partial contact panels that are covered by a pool liner and full contact panels that are fully exposed to the water. Pool assembly is not limited to utilizing one type of panel only, combinations of various panel types is permissible. For example, a combination of partial contact panels and full contact panels may be used to construct the side and end walls of the pool. Wall panels 207 may include sub-panels with active components, panels with passive components, panels with both active and passive components, and panels with neither active or passive components.

Wall panels 207 may comprise non-homogenous construction, having an upper panel or pool panel 209 and a lower panel 208 where pool panel 209 may be replaced or changed while the pool is filled with water. Accordingly, pool panel 209 may contribute nominally to the structural strength of the pool. For example, lower panel 208 may extend in height from the floor of the pool to span the depth of water considered non trivial. Pool panel 209 may extend in height from the top of lower panel 208 to span the depth of water considered trivial, and as will be explained, be able to be replaced even while partially submerged in water.

By way of a non-limiting illustrative example, wall panel 207 may be designed four feet in height, and eight feet in width. Lower panel 208 may comprise the bottom two feet in height, spanning the non-trivial depth of water. Whereas, pool panel 209 may affix to and seal with the top of lower panel 208, extending the remaining two feet in height, and spanning the trivial depth of water. As lower panel 208 may support non-trivial aspects of the pool design, it may include thicker walls than pool panel 209. Other height and width dimensions are also possible. Other primary characteristics, such as feature connection types and placements, may be specified. As such, suppliers may use wall panels 207 as platforms for a wide variety of enhanced add-on components. Accordingly, wall panel 207, and its sub-panels may be dimensioned as needed and may facilitate shipping by conventional methods and handling by one person.

Figure 11C:
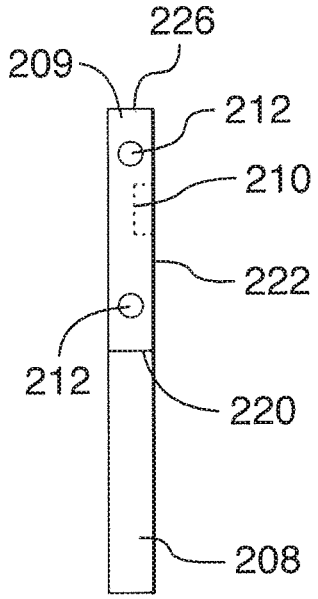
FIG. 11C is a side elevation view of a wall panel comprising a pool panel and a lower panel as shown in FIG. 11A.
Figure 11B:
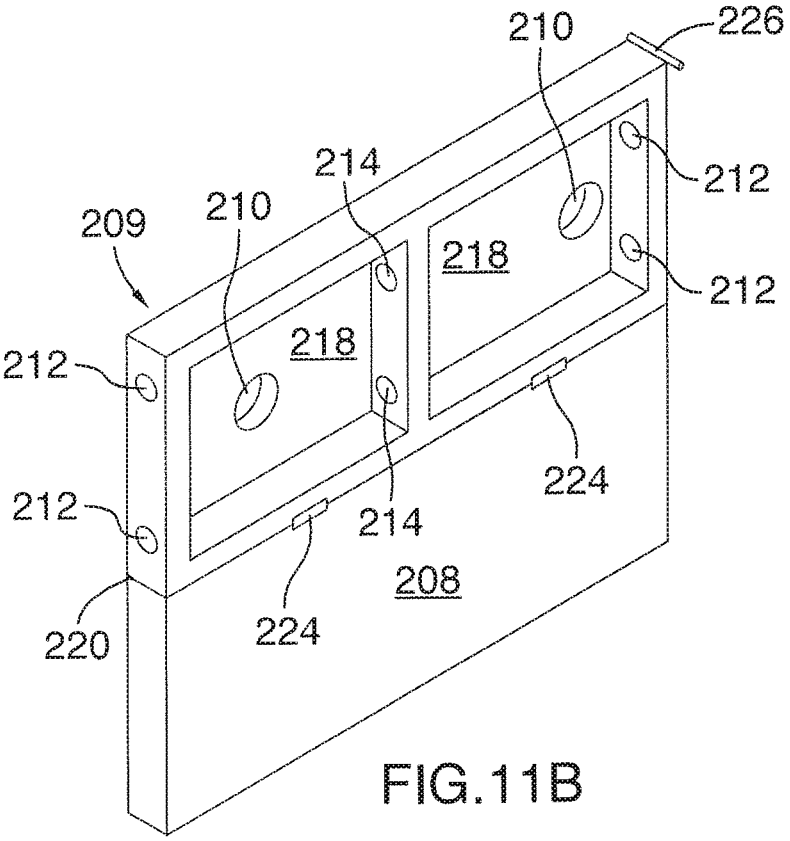
FIG. 11B is a perspective view of a wall panel comprising a pool panel and a lower panel as seen from an exterior side (outside of pool) of the wall panel.

FIG. 11B illustrates the interior or pool side of pool panel 209, mounted and sealed to the top surface of lower panel 208. Pool panel 209 may comprise inserts or ports 210, active/passive components 211 (not shown), side inserts or ports 212, vertical brace insert or ports 214, vertical brace 216, horizontal brace 217 (not shown), interior space 218, seal 220, side seal 222 (FIG. 11A), tabs 224, and pin 226.

Ports 210 are illustrated as two circular cavities tunneling through the interior and exterior pool facing wall portions. Ports 210 may however be sized and shaped accordingly to house any components 211 and is not limited to a circular design. Pool panel 209 may include any number of ports 210 or none at all. Example components include lights or ports for communicating water from an exterior of the pool to an interior of the pool.

Side ports 212 are illustrated as circular cavities in the side wall and cooperate with brace ports 214 to define a channel through a longitudinal length of pool panel 209. Ports 212 and 214 may however be sized and shaped accordingly to house any components 211 and are not limited to a circular design, for example, the may facilitate tubes passing through the ports which further communicate heat or water to various parts of the pool. Pool panel 209 may include any number of ports 212 and 214 or none at all.

Vertical brace 216 is illustrated as a single solid beam extending from top to bottom of the interior space 218 of pool panel 209. Vertical brace 216 may comprise brace ports 214. Vertical brace 216 provides additional rigidity to pool panel 216 and may comprise any suitable material, shape, and/or structure. There may be multiple vertical braces or none at all. Pool panel 209 may also comprise one or more horizontal braces 217 (not shown).

Figure 11D:
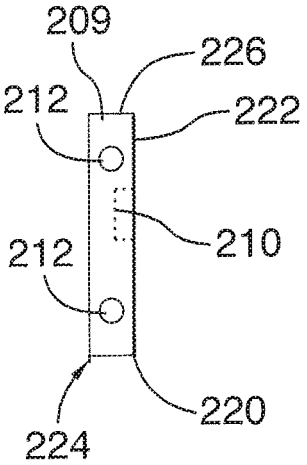
FIG. 11D is a side elevation view of a pool panel, as shown in FIG. 11C.

Seal 220 provides a water tight seal between the connecting surfaces of pool panel 209 and lower panel 208. For example, as shown in FIGS. 11C and 11D, pool panel 209 may comprise a seal on the interior side of its lower surface to affix with the top surface of lower panel 208 and define a water tight seal therewith. Seal 220 may be any appropriate seal, including a compression gasket. Similarly, the sides of the sub-panels may comprise a side seal 222 for creating a water tight seal with adjacent wall panels 207.

Pool panel 209 may further comprise tabs 224 which may engage and/or disengage the seal between pool panel 209 and lower panel 208.

Pool panel 209 may further comprise pin 226 which may be used to connect with a frame of a pool.

As illustrated in FIG. 11B, pool panel 209 provides in-panel mounting spaces 218, and other inserts or ports for mounting points and water access ports for operational subsystems, such as water transmission, water circulation, water filtering, in-panel hydroelectric power generation, water quality sensors, motion detectors, lights, etc. The panel also provides above water external mounting supports for other subsystems such as wave suppressors.

Components 211 may comprise active or passive components. Active components may use direct hydraulic power or other forms of energy that are in-panel derived, such as electrical energy generated from water-driven turbines, sometimes referred to as nano-hydro turbines. Other components may be powered by external sources, including electrical, gas, solar, and other commonly used sources of power known to those skilled in the art.

Pool panel 209 may comprise other components 211 including but not limited to, water transmission components, water capture and discharge components, electronic components such as computers, electrical components and electrical transmission components, electrical generation components, sound and lighting, sonar communications between devices, and sensors and actuators. The panels may provide active functions, such as wave damping or wave generation or surface cleansing, water filtration, etc. Panels with cameras may detect a swimmer's distress and initiate an alarm. Panels that can generate and detect different frequencies of electromagnetic pulses, especially in cross-pool transmissions, may detect anomalies in pool water quality, and redirect output nozzles so as to maintain more consistent water quality.

Wall panels 207 and their sub-panels may be made from any suitable building materials including transparent materials such as acrylic glass, commonly referred to by the tradename Plexiglas™. The panels may be made by any suitable manufacturing technique, including 3D printing. Panels should be designed in consideration of bearing non-trivial, trivial loads (or both), even though the balance of the more significant non-shear stress is exerted against the pool frame. Depending on the width and thickness of the panels, additional reinforcement along the walls of the panel to address shear stresses may be required.

Generally, wall panels 207 span the entire distance between adjacent frame brackets. For example, a pool frame 102 comprising a plurality of interconnected 2d-BCFC 110 or wrap-around brackets 111 defining a pool may sit spaced apart with a gap of 4-feet between adjacent brackets. A side wall of the pool may be formed by a plurality of panels, each panel having a width of 4-feet to span the gap between adjacent brackets where the vertical seam formed by adjoining panels is aligned with the brackets. Other arrangements are of course possible.

One type of wall panel 207 is a covered panel that is placed in a frame outside of the pool liner. Such panels may be less expensive to manufacture, may provide a 'cleaner' and more continuous pool surface, may be easier to install and replace, and may provide a double-layered security against catastrophic pool failure. Covered panels may require modification to the pool liner to accommodate interaction with the pool water.

The pool liner may need modification to communicate with ports 210 of pool panel 209. For example, the pool liner may need to include holes dimensioned to communicate with a component 211 which has been fitted to mate with a port 212, to communicate water from an exterior of the pool to an interior of the pool (or vice versa). For example, component 211 may be a water connection port, to facilitate fluid communication between the interior and exterior of the pool. Each single water connection may require a hole through the pool liner that is no larger than a 4" circle, thereby limiting the possibility of a catastrophic pool failure.

Pool panel 209 may include one or more water access ports that consist of a smaller water-proof subpanel (typically less than 4" diameter surface area) that comes with a corresponding water-proof cap allowing the sub-panel and/or smaller components to be exchanged while the sub-panel is below the water surface. The subpanel and components may be installed and fastened from the outside of the pool.

The panels may have a set pattern of ports, for instance 4" circles centered on the intersections of a 12" grid. The 4" circles may support inserts that may be designed and provided, such that another party may adapt the 4" port to any size of smaller ports or combination of smaller ports. The ports may further include covers that allow ports to be sealed if the port is taken out of use. Real-time panel replacement may require the use of a coffer dam, depending upon the types and sizes of any water connection ports.

Pool panels 209 may be partially above the pool liner but still below the water level; this may further include a sturdier pool liner, for example a rubber pool liner, spanning all parts of the pool located at non-trivial water depths. The water pressure at depths of less than 24" (e.g. the top two feet of water) is generally considered trivial and panels may be simply joined sufficiently well that leaks through the joints may be avoided. For example, lower panels 208 may extend in height to span all water depths except the top most two feet of water. A rubber liner may form a smooth and continuous layer of firm material coming up and rolling over the top surface of lower panel 208, creating a surface to mate with seal 220 of pool panel 209. Seal 220 may be a compression gasket type seal 220, running along the bottom and side edges of pool panel 209 and may be clamped, bolted, or otherwise fixed to lower panel 208. Lower panel 209 may also be clamped, bolted, or fixed to vertical joints created with adjacent panels to engage and secure with side seal 222, which may also be a gasket type seal, such as an expansion gasket. Pool panel 209 may also include tabs to leverage and engage or disengage the mating between pool panel 209 and lower panel 208. Pool panel 209 may further include pins or other connectors to connect with adjacent panels or brackets.

If a pool has wall areas that are not panelized, then the "rubber" pool liner may extend up to the top of the pool in those areas. It may be that some cuboid or any hard-walled pools may use as few as one full contact wall panel 207, but most pools will probably a plurality of wall panels 207, at least one on opposite sides of the pool. Pools may use full-contact panels along the entire longitudinal length of each side of the pool.

Pool panels 209 may use compression gaskets on the lower surface(s) and expansion gaskets on the side surfaces. The panels may use simple compressible fasteners (clamps, bolts, cam/compression levers, etc.). Pool panels 209 may use tabs 224 to hook with and connect to lower panel 208. If using tabs 224 without the aid of fasteners, affixing pool panel 209 to lower panel 208 may be accomplished by angling pool panel 209 to present tabs 224 to mate with cooperating holes 225 (not shown) on lower panel 208. Panel 209 may then angle forward to an upright position, thereby compressing seal 220 and mating lower panel 208 with pool panel 209, and creating a water tight seal therewith. The vertical gaps between wall panels 207 may use side seals 222 such as expansion gaskets, including separate rubber strips that are pressed or sucked into place or flexible surfaces that are fixed to the panels and expanded mechanically.

If a pool is constructed to have a maximum flow rate arising from any single failure of less than the flow capacity of a 4" drain, the non-trivial vertical joint along adjacent pool panels 209 may be, prior to sealing, 0.5" in width or less, because 0.5" along a 24" edge is equal to 12 square inches, almost the surface area of a 4" diameter drain pipe.

Each port 210, or 212 in a wall panel may be smaller than a 4" circle, limiting maximum flow rates in the event of failures, they may also be bigger than a 4" circle, or comprise shapes other than circles to co-operate with components 211. Full contact panels may not require standardized pool surface openings as the whole panel surface may be available for use.

Pool panels 209 may support real-time replacement of water-accessible components 211. Each below-water port 210 in a pool panel 209 may be capped on the interior side of the pool to create a water tight seal with port 210, allowing access to component 211 from an exterior side of the pool. A cap may include a gasket or other water tight sealing device. Components 211 may be removed from the exterior side of the pool when their corresponding port 212 is capped from an interior side of the pool. Below water ports 210 may be standardized in size to mate with typical components such as lights, water nozzles, drains, and sensors or may be standardized to a certain size, such as a 4" circle. This may simplify design constraints by supporting a standardized sealing cap for providing a water tight seal against an interior side of port 210.

Pool panels 209 may be replaced in real-time when supporting trivial stresses and covered by a pool liner. Real-time panel replacement may use a coffer dam. Pool panels 209 may be replaced without tools. For example, tabs 224 may be leveraged to disengage the seal 220 and fastening between pool panel 209 and lower panel 208, effectively popping pool panel 209 out. Trivial stresses supported by pool panel 209 may be temporarily supported by the pool liner until replacement with a new pool panel 209. This allows fast and effective modifications to any modular pool, including swapping out pool panels with different active and/or passive components.

Multiple systems of panel retention may be used. One system may be a passive retention scheme whereby the panel is friction fit into a frame opening that securely holds the panel, with brackets that prevent the panel from pushing outwards, for example, a wall panel 207 may be mated in the recess of an I-Beam 130 type vertical beam or, the joints of adjacent wall panels 207 may align with the structure of a square post type vertical beam 112. The passive retention scheme may be sufficient for many outdoor and indoor installations. A second layer of retaining hardware may be used to provide installations with greater reinforcement and may comprise clamps and/or bolts and/or pins that further secure wall panel 207 in place.

The pool wall panels may extend below the pool surface, may be replaceable while the pool is full, may be non-homogenous and multi-functional, may serve to contain less than 24.5" of water, by height, and may be less than 97" wide.

The pool wall panels may extend below the pool surface, may be replaceable while the pool has water, and may comprise active components that obtain all power from an external hydraulic flow source.

The pool wall panels may extend below the pool surface, may be replaceable while the pool has water, and may use electrical power that is generated in-panel or locally from an external hydraulic power source by wave motion or small hydraulically-driven turbines.

The pool wall panels may extend below the pool surface, may be replaceable while the pool has water, may comprise active features such as, but not limited to, water transmission components, water capture and discharge components, electronic components such as computers, electrical components and electrical transmission components, electrical generation components, sound and lighting, and sensors and actuators.

The pool wall panels may extend below the pool surface, may be replaceable while the pool has water, and may provide active functions, such as wave damping or wave generation or surface cleansing, water filtration, etc.

The concept of a platform-driven development for product families may be used herein to provide a relevant design framework. In particular, the paper "*Platform-Driven Development of Product Families: Linking Theory with Practice*", as authored by Johannes I. M. Halman et al, made publically available in the Journal of Product Innovation Management (2003), $20^{th}$ Volume, pages 149-162, provides such a framework. A platform is neither the same as an individual product, nor the same as a product family; it is the common basis of all individual products within a product family. A leading principle behind the platform concept is to balance the commonality potential and differentiation needs within a product family. A basic requirement therefore is the decoupling of elements to achieve the separation of common (platform) elements from differentiating (non-platform) elements. One possibility to build a platform is to define it by means of the product architecture. This product platform may be defined as a set of subsystems and interfaces that form a common structure from which a stream of related products can be developed and produced efficiently. Three aspects of the underlying logic of a product platform may be described as: (1) its modular architecture; (2) the interfaces (the scheme by which the modules interact and communicate); and (3) the standards (the design rules to which the modules conform). The main requirements for building a product family based on a product platform are (a) a certain degree of modularity to allow for the decoupling of elements and (b) the standardizing of a part of the product architecture (i.e., subsystems and/or interfaces). A modular product architecture in this context is characterized by a high degree of independence between elements (modules) and their interfaces.

An illustrative non-limiting platform example for designing pool panels may take the following goals and design principles in to consideration when deciding on an appropriate set of dimensions, panel types, bracket types, components, and other features used in constructing modular pools, such as cuboid pools.

Conceptually, the pool may be considered to cover two aspects: (i) trivial; and (ii) non-trivial. Trivial aspects generally comprises the parts of the pool supporting the uppermost two feet of water; the non-trivial aspects generally comprises parts of the pool supporting all the water beneath the uppermost two feet of water.

The non-trivial aspects of the pool may preferably include no openings, ports, drains, lights, etc.

The pool may be preferably designed to minimize or eliminate the chance of catastrophic failure and furthermore that the water be double-contained, at least for all non-trivial aspects of the pool, so that both containment systems, operating independently, cannot be subject to catastrophic failure. This will typically consist of hard walls combined with a vinyl (or rubber or plastic) pool liner, or double-walled hard panels.

The pool frame and pool walls preferably only nominally increase the footprint of the water surface over the ground.

The pool may forego use of external electrical sources anywhere in the pool structure. Preferably, the only source of external power or any type of external interface to the pool is water travelling through hoses, which may be non-metallic, non-electrically-conductive hoses.

The ports and dimensions of all trivial walls may be standardized to be the same.

Panels preferably may support two water pumps, one for pool water circulation and another for water-powered devices, and the panels should be dimensioned accordingly.

With the foregoing considerations in mind, an example pool panel 209 may be designed with the following considerations.

Spans only the top two feet of water (e.g. 24" tall), however, may also extend above the surface of the water.

Walls are 4" to 6" thick.

Panel width may range from 46" to 97".

Panels include protection against catastrophic failure (leakage)

Standardized input and output ports, in the end walls of the panels, for pressurized pool water transmission, return pool water transmission, power water transmission, and fresh water transmission.

Panels include adaptable and standardized ports and accompanying water sealable caps Pool panel components may include replaceable mini-filters, or input and output ports, in the bottom walls of the panels, for water transmission to and from a filter contained in the lower wall panels.

Pool panel components may include water circulation devices and water skimming devices.

Pool panel may have interior space sufficient to house and mount low-voltage hydro-electric power generating equipment and electrical and electronic equipment.

Pool panels are replaceable during operation of the pool.

Pool panels may support protruding hoses and/or protruding pipes that extend into the depths of the pool to transmit water to the bottom of the pool. This may not be as aesthetically pleasing as conventional pool designs but it is less prone to fail and more practical, especially for free-standing indoor pools Pool panels may comprise additional wall height to contain water 'ballast' from bather(s) entering the pool and increasing the water level. Pool panels may support for pool water return via the "overflow" method, preferably containing the water surge and retaining the excess water until the bather(s) exit the pool. As such, the maximum number of bathers should be chosen to not ballast the water level such that the pool panels support non-trivial amounts of water. Alternatively, an overflow gutter system and/or discharge drain may restrict the rate of exit of water to the same rate that the circulation pump is returning it to the pool allowing the panel design to potentially never support non-trivial amounts of water, regardless of the number of bathers.

Other types of new and old pools with solid walls may be designed or modified in order to use these panels. For example, an existing concrete wall pool can either have a 4" thick jog in the wall or have the wall cut out or notched out in order to add a panel, perhaps only one panel for the whole pool or more likely at least one panel in each wall.

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art.

The scope of the claims should not be limited by particular embodiments set forth herein, but should be construed in a manner consistent with the specification as a whole.

What is claimed is:

1. A pool bracket for use in assembling a pool frame for a pool, the pool bracket comprising:

a flexible lateral member for lying beneath the pool and for crossing a width of the pool between a first end and a second end of the flexible lateral member;

first and second vertical beams having corresponding first and second vertical support member receptors, the first and second vertical beams extending vertically upward respectively from the first end and the second end of the flexible lateral member;

first and second vertical support members received respectively by the first vertical support member receptor and the second vertical support member receptor, the first vertical support member and the second vertical support member each configured to extend above a height of the pool, and a connector configured to connect the first vertical support member and the second vertical support member above the height of the pool, the flexible lateral member and the connector tensioning the first vertical member and the second vertical member along an axis of the flexible lateral member.

2. A pool frame comprising:

a plurality of pool brackets as defined in claim 1, arranged in series and parallel to one another; and a plurality of first side members, each connecting the first vertical beam of adjacent pool brackets, and a plurality of second side members, each connecting the second vertical beam of adjacent pool brackets.

3. The pool frame of claim 2, further comprising a plurality of wall panels held in place by the plurality of pool brackets, the plurality of first side members, and the plurality of second side members, wherein at least one wall panel comprises a pool panel.

4. The pool frame of claim 3, further comprising a pool liner disposed on a pool side of the wall panels.

5. The pool frame of claim 3, wherein the pool panel comprises a port for housing a component.

6. The pool frame of claim 3, wherein the pool panel comprises a port for housing a water access port, a water transmission component, a water filter, a water quality sensor, a motion detector, a light, a wave actuator, a sonar device, or a camera.

7. The pool frame of claim 3 further comprising a plurality of second pool brackets arranged parallel to, and alternating in series with, the plurality of pool brackets, each of the plurality of second pool brackets comprising:

a second lateral member for lying beneath the pool and for crossing the width of the pool between a third end and a fourth end of the second lateral member;

a third vertical beam extending vertically upward from the third end of the second lateral member, and a fourth vertical beam extending vertically upward from the fourth end of the second lateral member;

wherein each of the plurality of first side members connects an adjacent pair of the first vertical beam and the third vertical beam, and wherein each of the plurality of second side members connects an adjacent pair of the second vertical beam and the fourth vertical beam.

8. The pool frame of claim 7 wherein the plurality of pool brackets and the plurality of lower pool brackets are arranged in alternating series, evenly spaced and equidistance apart.

9. The pool frame of claim 8 wherein adjacent pool brackets and second pool brackets are spaced four feet apart.

10. The pool bracket of claim 1 wherein the first vertical beam and the second vertical beam each comprise a hollow square tube.

11. The pool bracket of claim 1 wherein the first vertical beam and the second vertical beam each comprise a hollow circular tube.

12. The pool bracket of claim 1, wherein the first vertical beam and the second vertical beam each comprise an I-beam.

13. A kit for a pool bracket for assembling a pool frame for a pool, comprising:

a flexible lateral member for lying beneath the pool and for crossing a width of the pool between a first mounting location and a second mounting location of the flexible lateral member;

a first vertical beam having a first vertical support member receptor, the first vertical beam configured to be coupled to the first mounting location of the flexible lateral member and for extending vertically upward from the flexible lateral member;

a first vertical support member configured to be received by the first vertical support member receptor, the first vertical support member configured to extend above a height of the pool;

a second vertical beam having a second vertical support member receptor, the second vertical beam configured to be coupled to the second mounting location of the flexible lateral member and for extending vertically upward from the flexible lateral member;

a second vertical support member configured to be received by the second vertical support member receptor, the second vertical support member configured to extend above the height of the pool, and a connector for connecting the first vertical support member and the second vertical support member above the height of the pool, the flexible lateral member and the connector for tensioning the first vertical member and the second vertical member along an axis of the flexible lateral member.

14. The kit of claim 13, further comprising:

a first side member for connecting the first vertical beam of adjacent pool brackets, and a second side member for connecting the second vertical beam of the adjacent pool brackets.

* * * * *